US010151278B2

(12) United States Patent
Mallard

(10) Patent No.: US 10,151,278 B2
(45) Date of Patent: Dec. 11, 2018

(54) SYSTEM AND METHOD FOR A VARIABLE EXHAUST GAS RECIRCULATION DIFFUSER

(71) Applicant: Ford Global Technologies, LLC, Dearborn, MI (US)

(72) Inventor: William John Mallard, Southend on Sea (GB)

(73) Assignee: Ford Global Technologies, LLC, Dearborn, MI (US)

( * ) Notice: Subject to any disclaimer, the term of this patent is extended or adjusted under 35 U.S.C. 154(b) by 196 days.

(21) Appl. No.: 15/217,834

(22) Filed: Jul. 22, 2016

(65) Prior Publication Data

US 2017/0022941 A1 Jan. 26, 2017

(30) Foreign Application Priority Data

Jul. 24, 2015 (GB) ..... 1513093.3
Jul. 24, 2015 (IN) ..... 3807/CHE/2015

(51) Int. Cl.
*F02B 33/44* (2006.01)
*F02M 25/07* (2006.01)
(Continued)

(52) U.S. Cl.
CPC ..... *F02M 26/19* (2016.02); *F02M 26/07* (2016.02); *F02M 26/10* (2016.02)

(58) Field of Classification Search
CPC ..... F02M 26/19; F02M 26/07; F02M 26/10; F02M 26/63; F02M 26/37; F02M 26/39; F02M 26/21
(Continued)

(56) References Cited

U.S. PATENT DOCUMENTS 2,354,179 A * 7/1944 Blanc ..... F02M 26/19 123/568.17
3,626,913 A * 12/1971 Sarto ..... F02M 26/17 123/568.17
(Continued)

FOREIGN PATENT DOCUMENTS

JP 2012041828 A * 3/2012
JP 2012041836 A * 3/2012
(Continued)

OTHER PUBLICATIONS

A Machine Translation of Sukegawa et al. (Pub. No. WO 2006/129371 A1), published on Jul. 12, 2006.*
(Continued)

*Primary Examiner* — Thai Ba Trieu
(74) *Attorney, Agent, or Firm* — Julia Voutyras; McCoy Russell LLP

(57) ABSTRACT

Methods and systems are provided for an Exhaust Gas Recirculation (EGR) system for an internal combustion engine. In one example, the EGR system comprises an inlet air duct configured to provide the internal combustion engine with inlet air, an EGR diffuser configured to provide recirculated exhaust gases from the internal combustion engine to the inlet air duct through an outlet, and a resilient element, the EGR diffuser and resilient element adapted to provide homogenous mixing of EGR gases and inlet air at a specific operating condition of the vehicle.

16 Claims, 7 Drawing Sheets

(51) Int. Cl.
*F02M 26/19* (2016.01)
*F02M 26/07* (2016.01)
*F02M 26/10* (2016.01)

(58) Field of Classification Search
USPC ..... 60/605.2; 123/568.17
See application file for complete search history.

(56) References Cited

U.S. PATENT DOCUMENTS 4,461,150 A * 7/1984 Grohn ..... F02M 26/19 123/568.17
5,207,714 A * 5/1993 Hayashi ..... F02M 26/18 123/568.17
6,513,508 B2 * 2/2003 Fischer ..... F02M 26/18 123/568.17
6,672,292 B2 * 1/2004 Fischer ..... F02M 26/18 123/568.17
6,776,146 B1 8/2004 Ricart-Ugaz et al.
7,568,340 B2 8/2009 Marsal et al.
7,770,564 B2 * 8/2010 Emerick ..... F02M 26/19 123/568.17
7,798,135 B2 * 9/2010 Bischofberger ..... F02M 26/19 123/568.17
9,181,854 B2 * 11/2015 Lischer ..... F02M 26/19
2007/0107706 A1 5/2007 Berggren et al.
2007/0256413 A1 11/2007 Marsal et al.
2007/0271920 A1 * 11/2007 Marsal ..... F02M 26/19 60/605.2
2009/0165755 A1 * 7/2009 Shieh ..... F02M 26/19 123/568.17
2012/0297768 A1 * 11/2012 Lischer ..... F02M 26/19 60/605.2
2014/0331669 A1 11/2014 Jones et al.
2016/0153404 A1 * 6/2016 Guidi ..... F02M 26/19 123/568.17
2016/0160807 A1 * 6/2016 Polcyn ..... F02M 26/19 123/568.11
2016/0201610 A1 * 7/2016 Dahl ..... F02M 26/19 123/568.17
2016/0319778 A1 * 11/2016 Shuto ..... F02M 26/19

FOREIGN PATENT DOCUMENTS

JP 2012047097 A * 3/2012 ..... F02M 26/19
WO 2006129371 A1 12/2006

OTHER PUBLICATIONS

Examination Report of Great Britain Application No. 1513093.3, dated Jan. 27, 2016, 5 pages, United Kingdom Intellectual Property Office.

* cited by examiner

SYSTEM AND METHOD FOR A VARIABLE EXHAUST GAS RECIRCULATION DIFFUSER

CROSS REFERENCE TO RELATED APPLICATIONS

This application claims priority to Great Britain Patent Application No. 1513093.3, filed Jul. 24, 2015, and Indian Patent Application No. 3807/CHE/2015, filed Jul. 24, 2015, the entire contents of each of which are hereby incorporated by reference for all purposes.

TECHNICAL FIELD

The present disclosure relates to an Exhaust Gas Recirculation (EGR) diffuser.

BACKGROUND

A motor vehicle may be fitted with an Exhaust Gas Recirculation (EGR) system configured to recirculate a portion of the exhaust gases of an engine back to an inlet of the engine. Replacing a portion of the oxygen rich inlet air with burnt exhaust gases reduces the proportion of the contents of each cylinder of the engine which are available for combustion. This results in a lower heat release and lower peak cylinder temperature and thereby reduces the formation of $NO_x$.

In order for the engine to continue operating efficiently, it is desirable for the reintroduced EGR gases to be mixed homogenously with the inlet air. The engine usage, load, and range of speed determine the amount of EGR requested for the engine. In general, the EGR will mix with the fresh air more readily at some engine operating points than others. An EGR diffuser may be provided within the inlet air duct to facilitate mixing of the EGR gases and inlet air. For example, an EGR diffuser may utilize static features such as plates and hole patterns to dissipate and mix the EGR into the intake system of the engine. The geometry of the EGR diffuser may be defined to provide homogenous mixing of EGR gases and inlet air at a specific operating condition of the vehicle.

However the inventors herein have recognized potential issues with such diffusers. As an example, the above-discussed static features may cause the engine to work harder, resulting in pumping losses. As another example, they may deliver a less than desired EGR mass into the cylinders. This may be due to the request for a higher pressure differential required at the EGR diffuser to jet the EGR into the air stream. The issue may be exacerbated at high engine speeds where higher intake volumes can further raise the pressure differential required for EGR delivery. As such, this affects engine emissions and fuel economy.

STATEMENTS OF INVENTION

In one example, some of the above issues may be addressed by a method for an EGR system with an EGR diffuser. According to an aspect of the present disclosure, there is provided an Exhaust Gas Recirculation (EGR) system for an internal combustion engine, the EGR system comprising: an inlet air duct configured to provide the internal combustion engine with inlet air; an EGR diffuser configured to provide recirculated exhaust gases from the internal combustion engine to the inlet air duct through an outlet, the EGR diffuser comprising: a body portion; a movable element, movable relative to the body portion, the movable element configured to vary the size of the outlet, the movable element comprising a pressure surface, arranged such that at least one of inlet air and recirculated exhaust gases act on the pressure surface thereby causing the movable element to move in a first direction and vary the size of the outlet; and wherein the movable element is biased to move in a second direction.

The size of the outlet of the EGR diffuser may vary in response to changes in the flow of EGR gases and/or inlet air, that is, in response to a change of pressure of the EGR gases and/or inlet air. Allowing the size of the outlet of the EGR diffuser to vary may allow the EGR diffuser to introduce a desirable quantity of EGR gases according to the current engine running condition. Additionally or alternatively, varying the geometry of the EGR diffuser in this way may allow the EGR gases to be mixed more homogenously across a broad range of engine running conditions. Furthermore, an opening of each of a high pressure EGR (HP-EGR) valve and a low pressure EGR (LP-EGR) valve may be adjusted based on the resulting pressure differential at the EGR diffuser (and thereby the resulting opening of the EGR diffuser) so as to provide a target ratio of HP-EGR to LP-EGR.

The body portion of the EGR diffuser may comprise a portion of an EGR duct, configured to carry recirculated exhaust gases. The outlet may be between the body portion and the movable portion.

The EGR system may further comprise a resilient element configured to resist movement of the movable element. The resilient element may be provided between the movable element and the body portion of the EGR diffuser.

The movable element may be provided in the inlet air duct and may be configured to restrict the flow of air within the inlet air duct. For example, by inducing a pressure drop in the flow of inlet air. Movement of the pressure surface may vary the restriction of the flow of air within the inlet air duct.

The movable element may be movable between a first position and a second position. The outlet flow area may be greater in the first position compared to the second position.

The movable element may be configured to restrict the flow of air within the inlet air duct least when the movable element is in the first position.

The outlet flow area may vary linearly with the movement of the movable element between the first and second positions. Alternatively, the outlet flow area may vary non-linearly with the movement of the movable element between the first and second positions. The rate of change of the outlet flow area with the movement of the movable element may increase as the movable element moves from the first position to the second position. Alternatively, the rate of change of the outlet flow area with the movement of the movable element may decrease as the movable element moves from the first position to the second position.

The movable element may comprise a sleeve. The sleeve may be arranged co-axially with the body portion of the EGR diffuser. The sleeve may be provided radially outside the body portion. Alternatively, the sleeve may be provided radially inside the body portion. The body portion and the sleeve may comprise respective openings and the outlet may be at least partially formed by an overlapping area of the respective openings.

The openings may each comprise two substantially straight edges. The straight edges may be parallel to the coincident axes of the body portion and the sleeve. The openings may comprise semi-circular end profiles. Alternatively, the openings may be substantially triangular shaped.

The openings provided on the body portion and sleeve may be oriented in opposite directions, e.g. the peaks of triangular openings on the body portion and sleeve may point in opposite directions.

The resilient element may comprise a coil spring provided between the body portion and the sleeve.

The pressure surface may be provided on an end cap of the sleeve.

The movable element may comprise a plate configured to cover an opening provided on the body portion. The outlet may be at least partially formed by a flow area between the plate and the body portion. The pressure surface may comprise a surface of the plate.

The resilient element may be provided between the plate and the body portion.

The plate may be provided within the inlet duct and may restrict the flow of inlet air.

The plate may comprise one or more fins, which may be acted upon by the flow of inlet air. The pressure surface may comprise a surface of the one or more fins.

According to another aspect of the present disclosure, there is provided a vehicle comprising the EGR system according to a previously mentioned aspect of the disclosure.

BRIEF DESCRIPTION OF THE DRAWINGS

For a better understanding of the present invention and to show more clearly how it may be carried into effect, reference will now be made, by way of example, to the accompanying drawings, in which.

DETAILED DESCRIPTION

Figure 1:
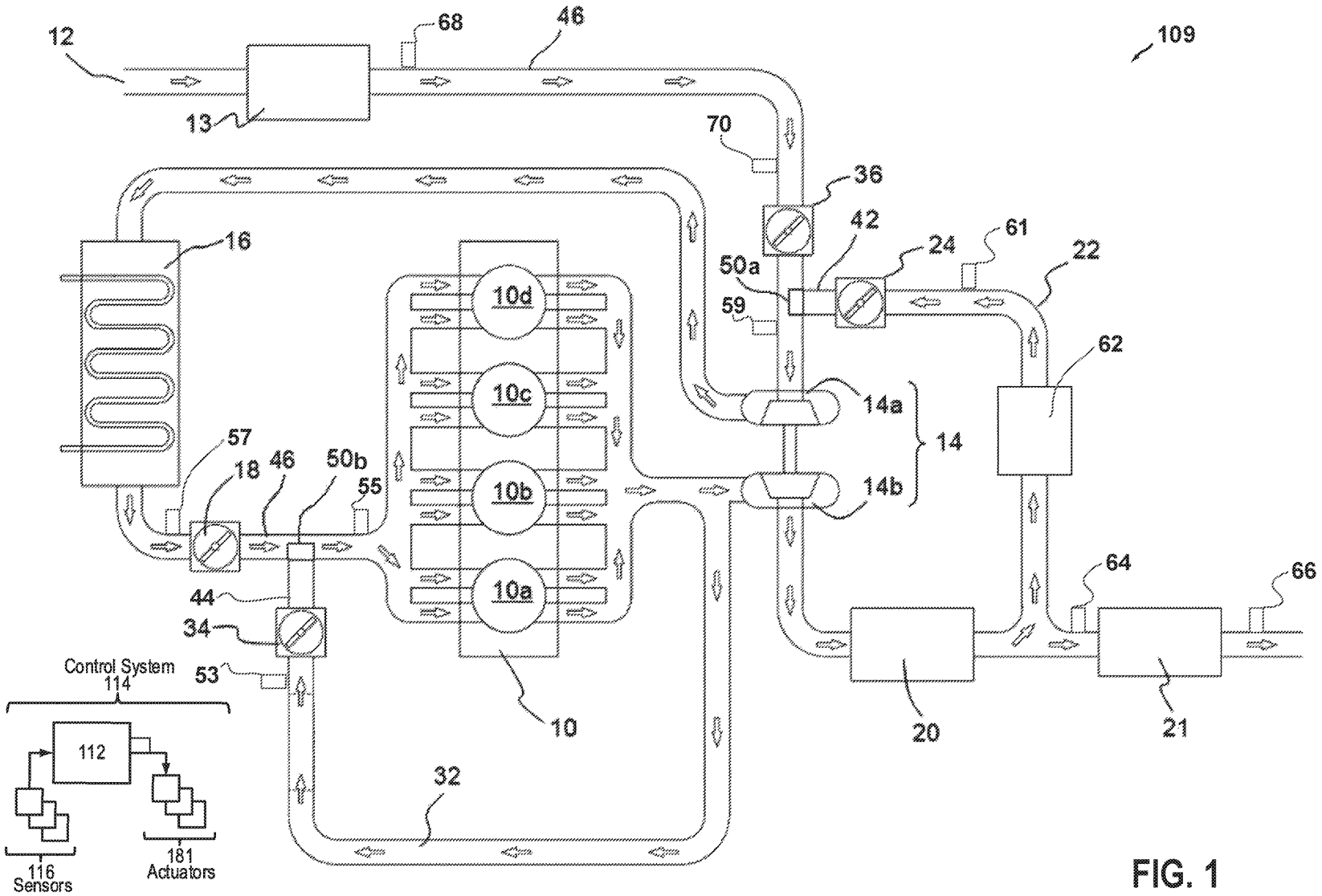
FIG. 1 is a schematic view of the air and exhaust paths in an engine with an EGR system according to arrangements of the present disclosure.

With reference to FIG. 1, a typical air path for an internal combustion engine 10 of a motor vehicle 109 is described. Air may enter through an inlet 12 and then pass through an air filter 13 via an inlet duct 46. The air may be throttled by a valve 36 before being passed through a compressor 14*a* of a turbocharger 14. The turbocharger 14 may increase the engine power output and reduce emissions. Typically, the turbocharger 14 is arranged with an exhaust gas driven turbine 14*b* driving the compressor 14*a* mounted on the same shaft. A charge air cooler 16 may further increase the density of the air entering the internal combustion engine 10, thereby improving its performance. The air may then enter the internal combustion engine 10 via a throttle 18 configured to vary the mass flow of air into the internal combustion engine.

In a particular arrangement of the present disclosure, the internal combustion engine 10 comprises a diesel engine, however it is equally envisaged that the engine 10 may be a spark ignition engine. As depicted in FIG. 1, the internal combustion engine 10 may comprise a number of cylinders 10*a-d* and the air may flow into each of these cylinders at an appropriate time in the engine's cycle as determined by one or more valves (not shown).

The exhaust gases leaving the internal combustion engine 10 may pass through the turbine 14*b* of the turbocharger. One or more exhaust treatment modules 20 may be provided downstream of the turbine 14*b*, e.g. to reduce emissions from the engine exhaust. The exhaust treatment modules 20 may comprise one or more of an oxidation catalyst, such as a diesel oxidation catalyst, and a particulate filter, such as a diesel particulate filter. A further exhaust treatment module 21 may be provided, e.g. downstream of the exhaust treatment module 20.

A first EGR loop 22, also referred to as a low pressure EGR passage, may be configured to selectively recirculate exhaust gases from engine exhaust of internal combustion engine 10, downstream of the turbine 14*b*, to the engine intake, upstream of the compressor 14*a*, via a first EGR duct 42. More specifically, the first EGR loop 22 may be provided about the turbocharger 14 such that exhaust gases leaving the turbine 14*b* may be recirculated through an EGR cooler 62 into the inlet of compressor 14*a*. An EGR diffuser 50*a* may be provided to increase mixing of the exhaust gases with the inlet air. The first EGR loop 22 may be diverted from the main exhaust flow path, either upstream or downstream of the exhaust treatment module 20. The first EGR loop 22 may comprise a first recirculation valve 24 (herein also referred to as a low pressure EGR valve, or LP-EGR valve), which may control the amount of low pressure EGR recirculated through the first EGR loop 22 and EGR diffuser 50*a* with a movable element relative to a body portion to create an outlet.

A high pressure EGR passage or second EGR loop 32, may be configured to selectively recirculate exhaust gases from engine exhaust of internal combustion engine 10, upstream of the turbine, to the engine intake, downstream of the compressor, back into the internal combustion engine via a second EGR duct 44. The second EGR loop 32 may be provided about the engine 10 with exhaust gases leaving the engine 10 being recirculated to the air inlet of the engine 10. An EGR diffuser 50*b* may be provided to increase mixing of the exhaust gases with the inlet air. The second exhaust gas recirculation loop 32 may be diverted from the main exhaust flow path, such as, at a point between the engine 10 and the turbine 14*b* of the turbocharger. Accordingly, the exhaust gases in the second EGR loop 32 may be at a higher pressure than the exhaust gases in the first EGR loop 22. The second exhaust gas recirculation loop 32 may comprise a HP-EGR valve 34 which may control the amount of recirculation in the second EGR loop 32 and an EGR diffuser 50*b* (similar to EGR diffuser 50*a* as described above), coupled to the engine exhaust, including a movable element relative to a body portion to create an outlet. EGR diffuser 50*a* and EGR diffuser 50*b* are interchangeable in function and herein may be referred to in general as EGR diffuser 50.

The vehicle system 109 may further include a control system 114. Control system 114 is shown receiving information from a plurality of sensors 116 (various examples of which are described herein) and sending control signals to a plurality of actuators 181 (various examples of which are described herein). The control system 114 may include a controller 112. The controller 112 may receive input data from the various sensors. For example, sensors 116 may include a sensor located in a conduit downstream of exhaust treatment module 20 and upstream of exhaust treatment module 21 such as a pressure sensor 64 to sense the pressure of the exhaust gas flowing from the engine to the atmosphere as well as a temperature sensor 66 located downstream of exhaust treatment module 21 to sense the temperature of the exhaust gas flowing from the engine to the atmosphere. As another example, sensors 116 may include a manifold absolute pressure (MAP) sensor 55 to sense the absolute pressure of the engine intake manifold- and/or a manifold air flow (MAF) sensor 57 to sense the air flow of the engine intake manifold, with these aforementioned sensors located in the intake passage of the engine intake manifold. As yet another example, sensors 116 may include EGR sensor 53 located upstream of HP-EGR valve 34 to sense the flow rate of EGR running through second EGR loop 32 as well as EGR sensor 61 located upstream of LP-EGR valve 24 to sense the flow rate of EGR running through first EGR loop 22. As yet another example, sensors 116 may include a compressor inlet pressure (CIP) sensor 59 located upstream of compressor 14*a* to sense the pressure of air flowing into the compressor and total inlet pressure (TIP) sensor 70 to sense the total pressure of the air flowing through the air inlet duct. As yet another example, sensors 116 may include a barometric pressure (BP) sensor 68 located downstream of air filter 13 to sense the barometric pressure of the air flowing through inlet 12.

As another example, the actuators may include throttle 18, throttle 36, LP-EGR valve 24, and HP-EGR valve 34. The controller 112, of control system 114, may receive input data from sensors, process the input data, and trigger the actuators in response to the processed input data based on instruction or code programmed therein corresponding to one or more routines. For example, the controller may send a signal to one or more of HP-EGR valve 34 and LP-EGR valve 24 to increase a degree of their opening responsive to an increase in the demand for engine dilution.

Figure 2A:
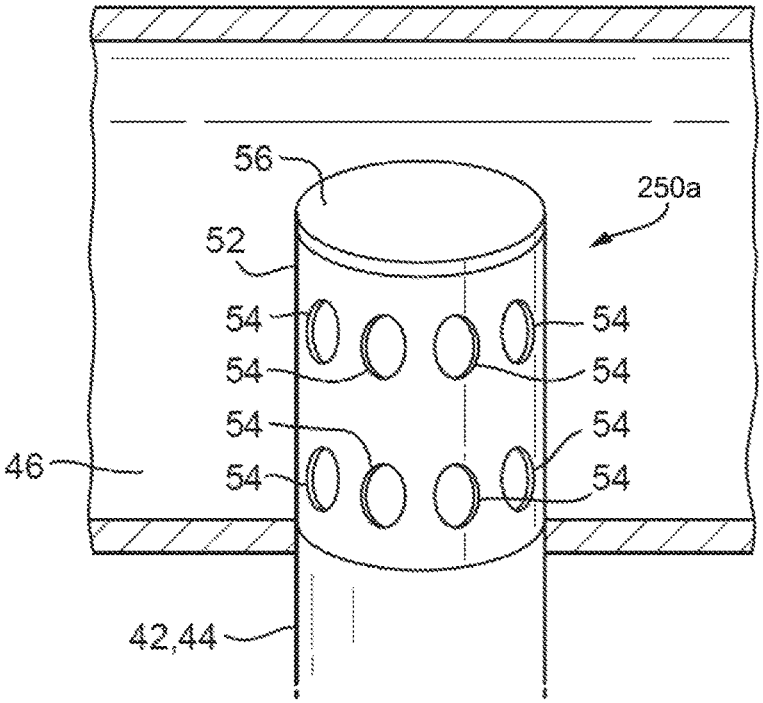
FIG. 2a Prior Art
FIGS. 2*a* and 2*b* are perspective views showing previously proposed EGR diffusers.

With reference to FIG. 2*a*, a previously-proposed EGR diffuser 250*a* (prior art) may be provided within the inlet air duct 46 and receive EGR gases via the EGR duct 42, 44. The inlet air duct is configured to provide the internal combustion engine with inlet air. The EGR diffuser is configured to provide recirculated exhaust gases from the internal combustion engine to the inlet air duct through an outlet. The EGR diffuser 250*a* may comprise a body portion, or diffuser body 52, provided within the inlet duct 46. As shown in FIG. 2*a*, the diffuser body may be cylindrical. An end cap 56, may be provided on the diffuser body to prevent EGR gases leaving the diffuser body in an axial direction relative to the diffuser body 52. A plurality of radial openings 54 may be provided, e.g., circumferentially distributed, around the diffuser body to allow EGR gases to leave the diffuser body 52 radially relative to the diffuser body 52 (and thus axially relative to the inlet duct 46. The openings may be provided in one or more rows of openings, distributed axially along the length of the diffuser body 52. The size of the openings 54 may be selected to promote optimal injection quantities and mixing of EGR gases at a specific operating condition of the vehicle.

Figure 2B:
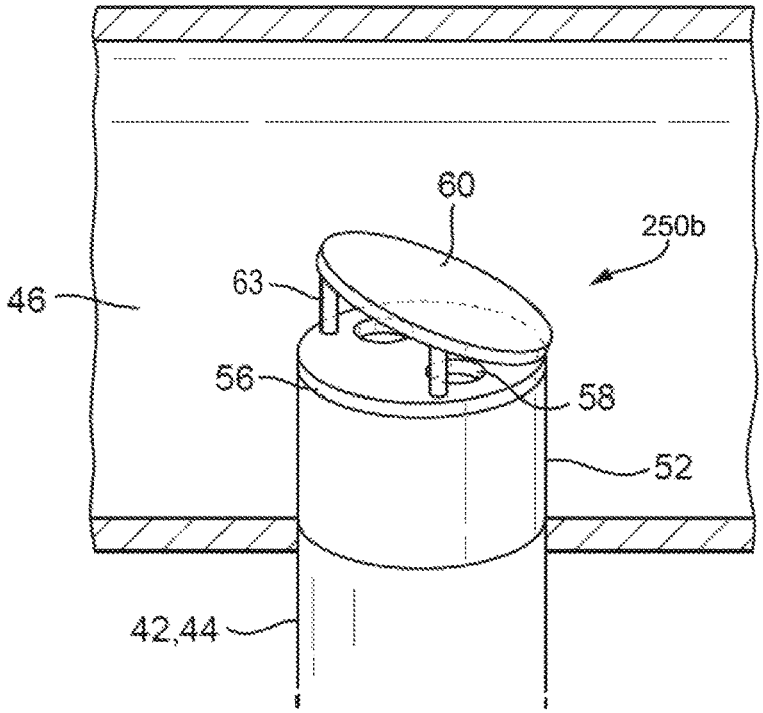
FIG. 2b Prior Art

With reference to FIG. 2*b*, rather than providing the radial openings 54, another previously-proposed EGR diffuser 250*b* (prior art) may alternatively comprise one or more axial openings 58, provided in the end cap 56 of the diffuser body 52. As shown in FIG. 2*b*, the diffuser may further comprise a diffuser plate 60 which is supported from the diffuser body 52 by one or more support legs 63. The support legs 63 may couple to the end cap 56 of the diffuser body 52 and may be arranged circumferential around the perimeter of the end cap 56. The lengths of the support legs may vary with respect to one another and may be configured to support the diffuser plate 60 at an angle relative to the flow of inlet air and/or EGR gases. Additionally or alternatively, the diffuser plate 60 may be coupled directly to the diffuser body at one or more locations. The diffuser plate 60 may be configured to increase the mixing of EGR gases with the inlet air. The size of the axial openings 58 and/or the position and angle of the diffuser plate 60 may be configured to promote optimal injection quantities and mixing of EGR gases at a specific operating condition of the vehicle.

Figure 3A:
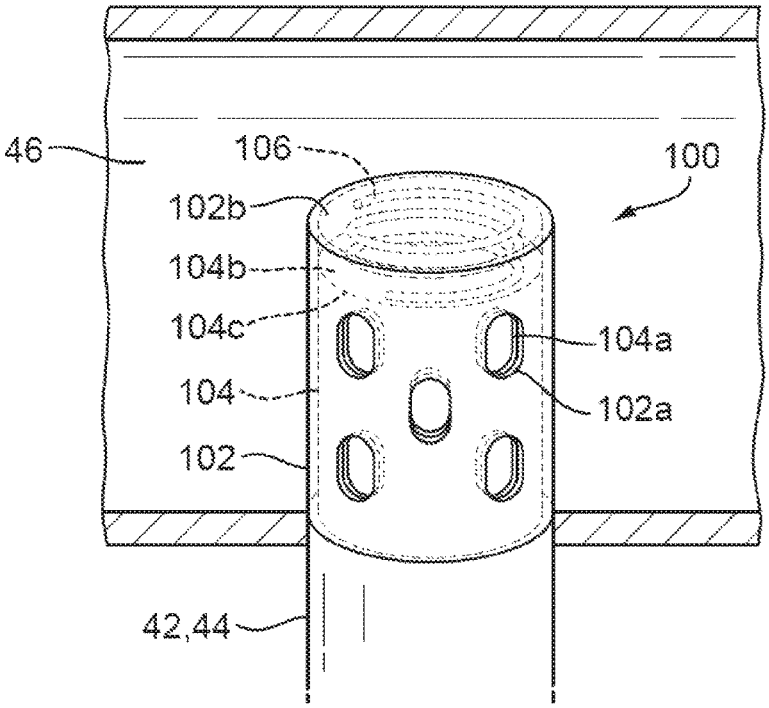
FIGS. 3*a* and 3*b* are perspective views of an EGR diffuser according to a first arrangement of the present disclosure, in open and closed configurations respectively.
Figure 3B:
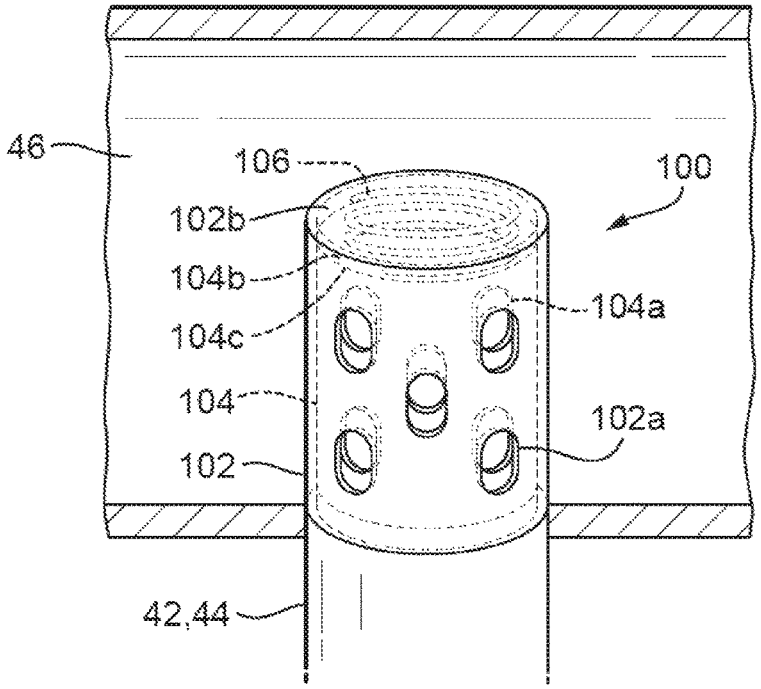

With reference to FIGS. 3*a* and 3*b*, a variable EGR diffuser 100, according to a first arrangement of the present disclosure, is described. The variable EGR diffuser 100 may be provided within the inlet duct 46 and may receive EGR gases from the EGR duct 42, 44.

The variable EGR diffuser 100 may comprise a diffuser body 102. The diffuser body may comprise a portion of the EGR duct 42, 44 which may extend into the inlet duct 46. Alternatively, as shown in FIGS. 3*a* and 3*b*, the diffuser body 102 may be a separate component, coupled to the EGR duct 42, 44. The diffuser body 102 may be coupled to a wall of the inlet duct 46. The diffuser body 102 may be substantially cylindrical, with a substantially constant circular cross-section along its length. The longitudinal axis of the cylinder may define an axis of the EGR diffuser 100. Additionally or alternatively, the diffuser body 102 may comprise one or more sections of any prism or cone formed on any regular or irregular polygonal base. The diffuser body 102 may be formed in an aerodynamic shape to minimise disturbance to the flow of inlet air in the inlet duct 46.

The variable EGR diffuser 100 may further comprise a movable element relative to the body portion, such as a sleeve 104. The sleeve 104 may be slidably coupled to the diffuser body 102. As depicted in FIGS. 3*a* and 3*b*, the sleeve 104 may be provided within (e.g., radially inside) the diffuser body 102, however it is equally envisaged that the sleeve 104 may be provided externally (e.g., radially outside) to the diffuser body 102. In either case, there may be a close fit between the sleeve 104 and the diffuser body 102, to reduce the flow of exhaust gases between the components.

The diffuser body 102 may comprise one or more openings 102*a*. The openings may extend into the diffuser body 102 in a substantially radial direction, relative to the longitudinal axis of the EGR diffuser. The openings may be circumferentially distributed, e.g., partially or fully, around the diffuser body. The openings may be evenly or variably spaced around the circumference of the diffuser body. For example, the openings may be arranged such that there is a greater number on an upstream side of the variable EGR diffuser 100, with respect to the flow of inlet air within the inlet duct 46, compared to on a downstream side, or vice versa.

The sleeve 104 may be provided with corresponding openings 104*a*. The corresponding openings 104*a* may be configured to overlap with the openings 102*a* to define one or more outlets of the variable EGR diffuser 100. As such, the sleeve 104 may be configured to vary the size of the outlet, as it is slidably coupled to the diffuser body. As shown in FIG. 3*a*, when the sleeve 104 is located in a particular position relative to the diffuser body 102, each of the corresponding openings 104*a*, provided in the sleeve

104, may align with, e.g. substantially overlap, the openings 102*a*, provided in the diffuser body 102. In this position, the size of the outlets of the variable EGR diffuser 100 may be at a maximum. For example, the outlets may be substantially open. In this way, the movable element comprises the sleeve 104 arranged co-axially with the body portion of the EGR diffuser. The body portion and the sleeve comprise respective openings with the outlet at least partially formed by an overlapping area of respective openings.

The sleeve 104 may comprise an end cap 104*b*, which closes a distal end of the sleeve 104. The end cap 104*b* may be arranged such that EGR gases exiting the EGR duct 42, 44 impinge upon a pressure surface 104*c* provided on the inside of the end cap 104*b*.

As shown in FIGS. 3*a*, and 3*b*, the diffuser body 102 may comprise an end cap 102*b* to prevent EGR gases exiting the diffuser body in an axial direction. However, if the sleeve 104 is provided externally to the diffuser body 102, the diffuser body may not comprise an end cap in order to allow the EGR gases to exit the EGR diffuser body axially and impinge upon the pressure surface 104*c* of the sleeve 104.

The pressure force resulting from the EGR gases impinging upon the pressure surface 104*c* may affect the position of the sleeve relative to the diffuser body, that is, the pressure force may cause the sleeve to be displaced axially relative to the diffuser body. As depicted in FIG. 3*b*, displacing the sleeve 104 relative to the diffuser body 102 may cause the openings 102*a* and corresponding openings 104*a* to move relative to one another and hence the area of the outlet of the variable EGR diffuser 100 may change. In a particular arrangement, displacing the sleeve 104 relative to the diffuser body 102 may cause the openings 102*a* and corresponding openings 104*a* to move out of alignment and hence the area of the outlet of the variable EGR diffuser 100 may be reduced.

In this way, the EGR diffuser comprises a body portion; a movable element, movable relative to the body portion, the movable element configured to vary the size of the outlet, the movable element comprising a pressure surface. The movable element is provided in the inlet air duct and is configured to restrict the flow of air within the inlet air duct such that the movable element varies the restriction of flow of air within the inlet air duct.

In FIG. 3, for example, the movable element may comprise a sleeve. The movable element comprises a pressure surface provided on an end cap of the sleeve. The pressure surface is arranged such that at least one of inlet air and recirculated exhaust gases act on the pressure surface thereby causing the movable element to move in a first direction and vary the size of the outlet. In the absence of EGR flow, the movable element is biased to move in a second direction. As such, the movable element is movable between a first position and a second position, a flow are through the outlet being greater in the first position as compared to the second position. The movable element is configured to restrict the flow of air within the inlet air duct least when the movable element is in the first position.

The variable EGR diffuser 100 may further comprise a resilient element, e.g., a coil spring 106, which may be configured to resist movement of the sleeve 104 relative to the diffuser body 102. The resilient element, or coil spring, is provided between the movable element and the body portion of the EGR diffuser. The resilient element may be configured to return the variable EGR diffuser 100 to a position in which the outlet size is open when the pressure force applied to the pressure surface 104*c* is low. The coil spring 106 may be provided between the end cap 102*b* of the diffuser body, and the end cap 104*b* of the sleeve.

The stiffness of the spring 106 may be selected in order to control the effect of a change in EGR flow pressure on the size of the outlets of the variable EGR diffuser 100. Additionally or alternatively, the stiffness of the spring 106 may be selected such that the maximum pressure experienced by the pressure surface 104*c* causes the sleeve 104 to be displaced into a closed (or partially closed) position, in which the size of the outlets of the EGR diffuser is reduced, as shown in FIG. 3*b*. Additionally or alternatively, the length of the spring may be selected such that, when the sleeve 104 is displaced into the closed (or partially closed) position, the spring is compressed to its shortest length. Again, additionally or alternatively, the diffuser body 102 and the sleeve 104 may comprise a shoulder and a corresponding abutment face (not shown), which may prevent the sleeve 104 being displaced beyond the closed position, regardless of whether the pressure force increases and the spring 106 is able to be compressed further.

Additionally or alternatively to providing a resilient element, such as the coil spring 106, the sleeve 104 may be weighted. The sleeve 104 may thereby be biased to return to the position in which the outlet size is substantially open, when the pressure force applied to the pressure surface 104*c* is reduced.

As the sleeve 104 moves relative to the diffuser housing 102, the area of the variable EGR diffuser outlets may vary linearly with the displacement of the sleeve at least for a portion of the sleeve's travel. Such variation may be achieved by providing openings 102*a*, 104*a* that comprise straight, parallel sides aligned in the direction of movement of the sleeve 104. For example, as shown in FIGS. 3*a* and 3*b*, the openings 102*a*, 104*a* may be substantially rectangular and may comprise profiled ends, such as semi-circular ends as depicted. The semi-circular ends of the openings may provide outlets that are substantially circular when the outlets are closed, as shown in FIG. 3*b*. Alternatively, the openings may be any other shape, such as triangular. Each of the openings may be a different shape and/or orientation compared to the other openings. In this way, the flow area through the outlet varies linearly with the movement of the movable element between the first and second positions. Further, the flow area through the outlet may vary non-linearly with the movement of the movable element between the first and second positions.

In one alternative arrangement, not shown, the openings 102*a*, 104*a* are triangular and the openings 104*a* provided on the sleeve 104 are arranged at an angle of 180° relative to the openings 102*a* on the diffuser body 102. By providing openings of different shapes and/or orientations, the rate of change of the size of the outlets may vary as the sleeve 104 is displaced. For example the rate of change of the outlet size may increase or decrease linearly or quadratically with the displacement of the sleeve 104. In this way, the rate of change of the outlet flow area with the movement of the sleeve 104, or movable element, increases as the sleeve 104 moves from the first position to the second position.

Figure 4A:
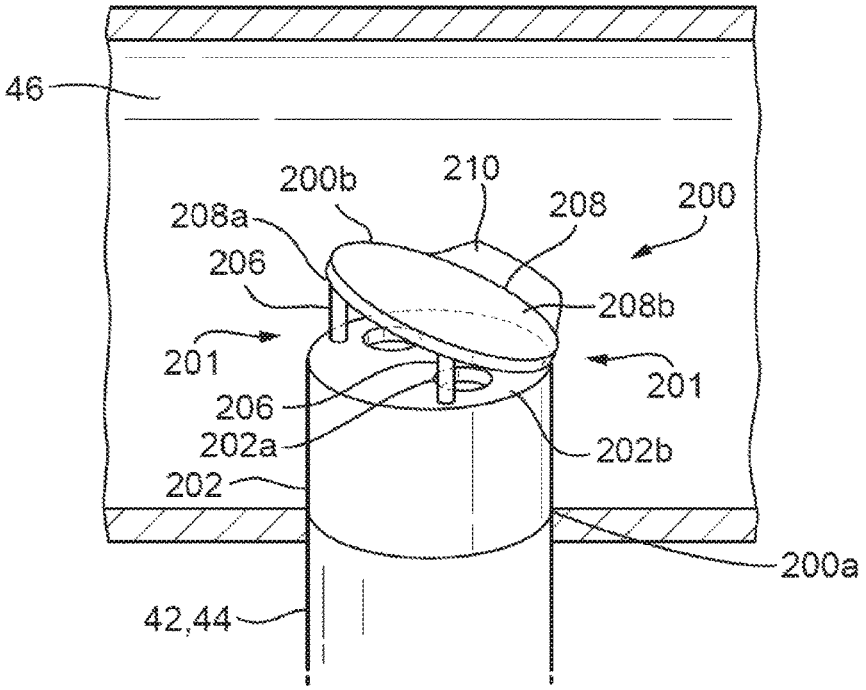
FIGS. 4*a* and 4*b* are perspective views of an EGR diffuser according to a second arrangement of the present disclosure, in closed and open configurations respectively.
Figure 4B:
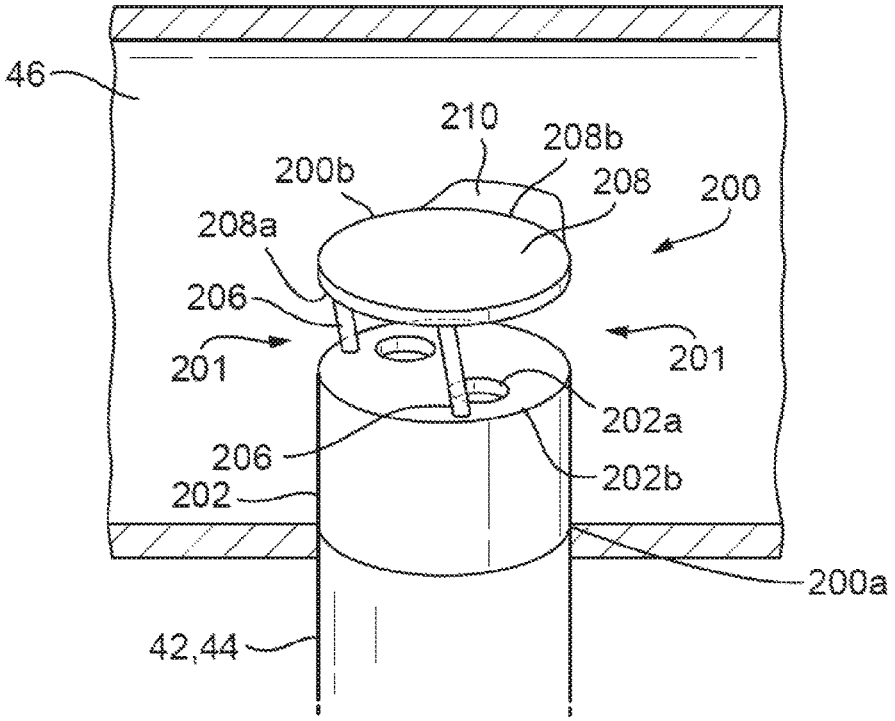

With reference to FIGS. 4*a* and 4*b*, a variable EGR diffuser 200, according to a second arrangement of the present disclosure is described. The variable EGR diffuser 200 may be coupled, at a first end 200*a*, to the wall of the inlet duct 46. The variable EGR diffuser 200 may extend into the inlet duct 46 to a second end 200*b*. The variable EGR diffuser 100 may receive EGR gases from the EGR duct 42, 44.

The EGR diffuser 200 may comprise a diffuser body 202, which may be similar to the EGR body 102 described above, however the diffuser body 202 may not comprise radial openings. The diffuser body 202 may comprise an end cap 202*b*, which may be provided with one or more openings 202*a*. The openings 202*a* may be provided in an axial direction of the diffuser body 202 to allow EGR gases to exit the diffuser body axially. Alternatively, the end cap 202*b* may be omitted and the opening 202*a* may correspond to an open second end of the diffuser body 202.

The EGR diffuser 200 may further comprise a diffuser plate 208. The diffuser plate may be provided at or near the second end 200*b* of the EGR diffuser. The diffuser plate 208 may be supported from the diffuser body 202 by one or more resilient support members 206. The resilient support members 206 may be elongate and may extend from the diffuser body 202 towards the diffuser plate 208. The diffuser plate 208 may be configured to rotate relative to the diffuser body 202. For example, the resilient support member 206 may be elastically deformable to allow the angle of the diffuser plate 208 to vary. The resilient support member 206 may comprise a leaf spring or another form of natural spring. In an alternative arrangement, the resilient support member may comprise a hinge, flexure bearing or other pivot, which allows the diffuser plate 208 to rotate relative to the diffuser body 202. The gap between the diffuser body 202 and the diffuser plate 208 may define an outlet 201 of the variable EGR diffuser 200.

The resilient support member 206 may be provided at or near an edge of the end cap 202*b*. In the arrangement shown in FIGS. 3*a* and 3*b*, the resilient support member 206 is provided at an upstream position relative to the flow of inlet air. However, it is equally envisaged that the support member could be provided at a downstream position, or any other position on the end cap 202*b*.

As shown in FIG. 4*a*, the diffuser plate 208 may be angled with respect to the flow of EGR gases leaving the EGR diffuser via the openings 202*a* and the flow of inlet air within the inlet duct 46. In a neutral position of the diffuser plate 208, in which the resilient support member 206 is substantially undeformed, the plate may be angled such that an upstream end of the diffuser plate is arranged further from the end cap 202*b* than a downstream end of the diffuser plate, e.g., the diffuser plate may be angled downwards relative to the flow of inlet air.

The diffuser plate 208 may be biased into the neutral position due to the stiffness of the resilient support member. Additionally or alternatively, for example if the resilient support member 206 comprises a hinge, flexure bearing or pivot, a spring may be provided to bias the diffuser plate 208 into the neutral position. Again additionally or alternatively, the diffuser plate 208 may be weighted, which may bias the diffuser plate into the neutral position.

In the configuration shown in FIG. 4*a*, the diffuser plate is provided within the flow of inlet air within the inlet duct 46, 48. The diffuser plate may restrict the flow of inlet air and may induce a pressure drop (or pressure differential) in the inlet air. The diffuser plate may be configured to provide optimised mixing of EGR gases with the inlet air in a particular vehicle operation condition.

The diffuser plate 208 may comprise an inferior face 208*a*, which is provided adjacent the diffuser body 202, and a superior face 208*b* on the opposite side of the plate. EGR gases exiting the diffuser body 202 may impinge upon the inferior face 208*a* of the diffuser plate 208. Inlet air within the inlet duct 46 may also impinge upon the inferior face 208*a*. The impinging gases may increase the pressure on the inferior face of the diffuser plate, which may create a net pressure difference between the inferior and superior face of the diffuser plate. Additionally, inlet air, which is deflected by the diffuser plate 208, may form a low pressure region adjacent to the superior face 208*b* of the diffuser plate, which may increase the net pressure difference. The net pressure difference may result in a pressure force which causes a deflection of the resilient support member 206, e.g., bending of the resilient support member. As shown in FIG. 4*b*, deflection of the resilient support member 206 may alter the angle of the diffuser plate 208 relative to the flows of EGR gases and inlet air.

In the configuration shown in FIG. 4*b*, the flow area of the outlet 201 of the variable EGR diffuser 200, between the diffuser body 202 and the diffuser plate 208, may be larger than in the configuration shown in FIG. 4*a*. The configuration shown in FIG. 4*a* may be considered a first configuration and the configuration shown in FIG. 4*b* may be a second configuration in which the outlet 201 is more open than in the first configuration.

In the second configuration, the projected area of diffuser plate, in the direction of the flow of inlet air, may be reduced compared to the first configuration. The diffuser plate 208 may therefore restrict the flow of inlet air less and the pressure drop induced in the inlet air flow by the diffuser plate may also be reduced. Such a configuration may be desirable when high efficiency of the inlet air system is desired.

In another arrangement, not shown, the diffuser plate 208 and/or resilient support member 206 may be configured such the pressure forces caused by impinging EGR gases and inlet air, act to reduce the size of the outlet 201 between the diffuser body 202 and the diffuser plate 208. For example, the diffuser plate 208 and/or resilient support member 206 may be configured such the inlet air impinges upon the superior face 208*b* of the diffuser plate 208. This may be achieved by orienting the diffuser plate 208 the other way round to that shown in FIG. 4*a*, e.g., such that the downstream end of the diffuser plate 208 is arranged further from the end cap 202*b* than the upstream end, when the diffuser plate 208 is in the neutral position. Additionally or alternatively, the diffuser plate 208 and/or the resilient support member 206 may be configured such that the projected area of the diffuser plate, in the direction of the flow of inlet air, is smallest when the diffuser plate is in the first configuration.

As described above, the flow area of the outlet 201 of the EGR diffuser 200, and the effect of the diffuser plate 208 on the pressure drop of the inlet flow may be affected by the angle of the diffuser plate. In some configurations of the inlet and/or EGR system, it may be desirable to increase the effect of the inlet air flow on the angle of the diffuser plate, without altering the effect of the EGR gas flow. In this case, one or more diffuser fins 210 may be provided on the diffuser plate 208. As such, the plate comprises one or more fins, which are acted upon by the flow of inlet air. In this way, the pressure surface comprises a surface of the plate and a surface of the fin. The fins 210 may be provided on an edge of the diffuser plate 208, and may extend radially outwards from the diffuser plate 208. The fins 210 may extend in a plane parallel with the diffuser plate 208. Alternatively, the fins 210 may be provided at an angle relative to the diffuser plate 208. The angle of the fins 210 relative to the diffuser plate 208 may vary with distance from the diffuser plate 208, e.g. the fins may curve and/or bend away from the plane of the diffuser plate 208. Inlet air within the inlet duct 46 may impinge upon an inferior and/or superior surface of the diffuser fins 210, which may affect the pressure force on the diffuser plate 208 acting to deflect the resilient support members 206. The angle of the diffuser fins 210 relative to the diffuser plate 208 may be adjusted to alter the effect of the fins 210 on the pressure force. The fins 210 may be arranged such that the flow of exhaust gases from the diffuser body 202 does not impinge upon the fins 210.

Figure 5A:
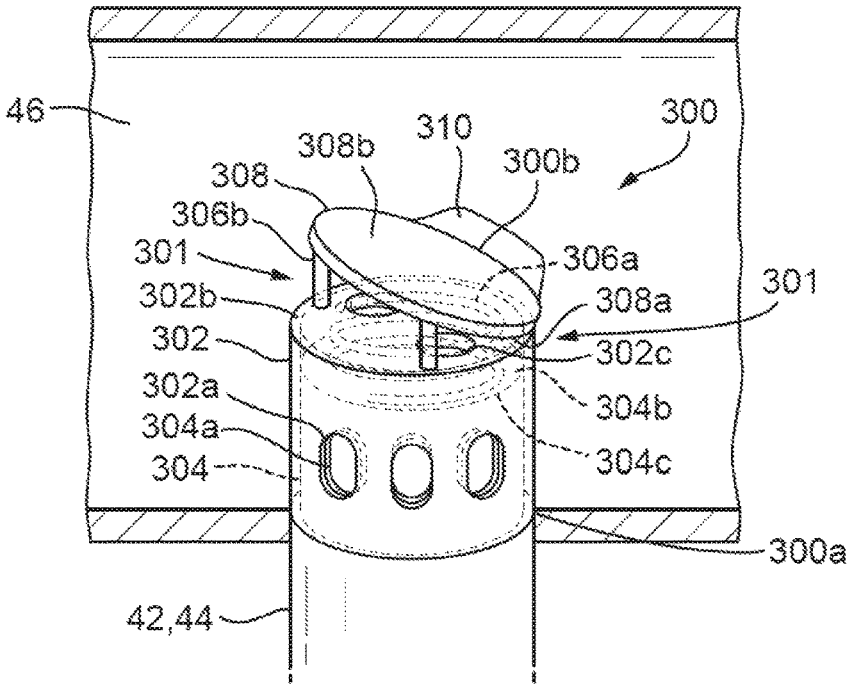
FIGS. 5*a* and 5*b* are perspective views of an EGR diffuser according to a third arrangement of the present disclosure.
Figure 5B:
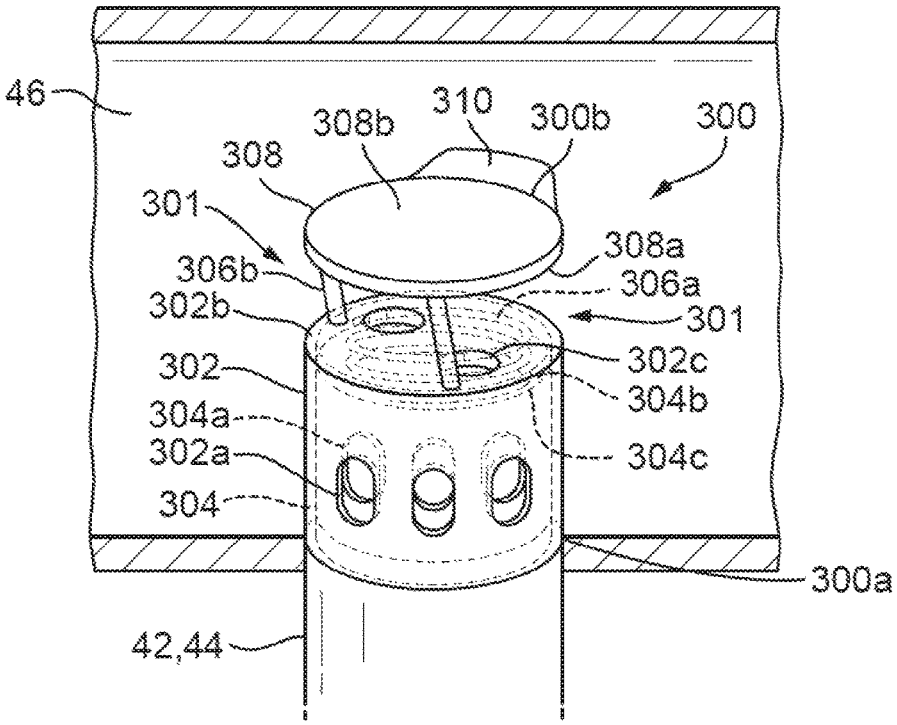

With reference to FIGS. 5*a* and 5*b*, a variable EGR diffuser 300, according to a third arrangement of the present disclosure is described. The variable EGR diffuser 300 may be coupled, at a first end 300*a*, to the wall of the inlet duct 46. The variable EGR diffuser 300 may extend into the inlet duct 46 to a second end 300*b*. The variable EGR diffuser 300 may receive EGR gases from the EGR duct 42, 44.

The variable EGR diffuser 300 may comprise a diffuser body 302 and a sleeve 304. The diffuser body 302 may be configured similarly to the diffuser body 102 and may comprise one or more radial openings 302*a*. The sleeve 304 may be configured similarly to the sleeve 104 and may comprise corresponding openings 304*a*, which align with the openings 302*a* when the sleeve is arranged in an open configuration, as shown in FIG. 5*a*.

The sleeve 304 may further comprise an end cap 304*b*. An inner surface of the end cap 304*b* may be a pressure surface 304*c* of the sleeve 304. EGR gases may impinge upon the pressure surface 304*c*, as described above with reference to the sleeve 104, which may cause a displacement of the sleeve 304 relative to the diffuser body 302.

As described above with reference to FIGS. 3*a* and 3*b*, one or more outlets of the variable EGR diffuser 300 may be defined by the overlap of the openings 302*a* and the corresponding openings 304*a*. The shape and/or orientation of the openings 302*a* and/or corresponding openings 304*a* may be configured, as described above, to determine the size and/or shape of the outlets of the variable EGR diffuser 300, as well as the rate of change of outlet size and/or shape as the sleeve 304 is displaced relative to the diffuser body 302.

The variable EGR diffuser 300 may further comprise a resilient element 306*a* configured to resist movement of the sleeve 304 relative to the diffuser body 302. The resilient element may comprise a coil spring and may be configured similarly to the resilient element 106 described above.

The diffuser body 302 may comprise an end cap 302*b*, at or near the second end 300*a* of the variable EGR diffuser. The end cap 302*b* may be configured similarly to the end cap 202*b* and may comprise one or more axial openings 302*c*. As described above with reference to FIGS. 4*a* and 4*b*, the diffuser body 302 may not comprise the end cap 302*b*, and the axial opening 302*c* may correspond to an open second end of the diffuser body 302.

The variable EGR diffuser 300 may further comprise a diffuser plate 308 and resilient support member 306*b*, which may be configured similarly to the diffuser plate 208 and resilient support member 206 described above. The variable EGR diffuser 300 may therefore also comprise an outlet 301 defined between the diffuser body 302 and the diffuser plate 308.

The diffuser plate 308 may comprise an inferior surface 308*a* adjacent to the diffuser body 302 and a superior surface 308*b* on the opposite side of the diffuser plate 308. As described above with reference to the diffuser plate 208, the EGR gases and the inlet air may impinge upon the inferior surface 308*a* and may cause a pressure difference between the inferior surface 308*a* and the superior surface 308*b*.

The pressure difference may produce a pressure force, which deforms the resilient support member 306*b* and affects the angle of the diffuser plate 308 relative to the flows of inlet air and EGR gases. The angle of the diffuser plate 308 may affect the size of the outlet 301 of the variable EGR diffuser 300 defined between the diffuser body 302 and the diffuser plate 308. The angle of the diffuser plate may also affect a restriction on the flow of inlet air within the inlet duct and/or a pressure differential of the inlet air caused by the diffuser plate 308. When the diffuser plate is in an open configuration, as shown in FIG. 5*b*, the size of the outlet 301 may be substantially open and the restriction on the inlet air and the induced pressure differential may be small.

In order to allow EGR gases to impinge upon the inferior surface 308*a* of the diffuser plate 308, the end cap 304*b* of the sleeve 304 may comprise one or more axial openings (not shown) to permit a flow of EGR gases axially though the variable EGR diffuser 300.

Providing the axial opening may reduce the effect of the EGR gases on the displacement of the sleeve 304 relative to the diffuser body 302. The stiffness of the resilient element 306*a* may therefore be reduced compared to the stiffness of the resilient element 106 described above.

The diffuser plate 308 may be provided with one or more optional diffuser fins 310, which may allow the effect of the inlet air on the angle of the diffuser plate 308 to be adjusted independently to the effect of EGR gases, as described above with reference to the diffuser fins 210.

As shown in FIG. 5*a*, when the EGR gas pressure and inlet air flow rate are both low, the outlets defined by the overlapping of the openings 302*a* and corresponding openings 304*a* may be in an open configuration, whilst the outlet 301 defined between the diffuser body 302 and the diffuser plate 308 may be in a substantially or partially closed configuration.

As shown in FIG. 5*b*, when the EGR gas pressure and inlet air flow rate are both high, the outlets defined by the overlapping of the openings 302*a* and corresponding openings 304*a* may be in a closed or partially closed configuration, whilst the outlet 301 defined between the axial opening diffuser body 302 and the diffuser plate 308 may be in a substantially open configuration.

When the variable EGR diffuser 300 is configured as shown in FIGS. 5*a* and 5*b*, if the EGR pressure is low and the inlet air flow rate is high, the outlets defined by the overlapping of the openings 302*a* and corresponding openings 304*a*, and the outlet 301 defined between the diffuser body 302 and the diffuser plate 308 may both be in a substantially open position at the same time. Similarly, the variable EGR diffuser 300 may be configured such that, under certain conditions, the outlets are both in substantially or partially closed configurations at the same time.

In this way, the EGR diffuser comprises a body portion; a movable element, movable relative to the body portion, the movable element configured to vary the size of the outlet, the movable element comprising a pressure surface. For example, in FIGS. 4-5, the movable element may comprise a plate, the plate configured to cover an opening provided on the body portion, the outlet at least partially formed by a flow area between the plate and the body portion, with the plate is provided within the inlet duct to restrict the flow of inlet air. Further, the plate may comprise one or more fins, which may be acted upon by the flow of inlet air. The pressure surface face may comprise a surface of the one or more fins.

FIGS. 1-5 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Figure 6:
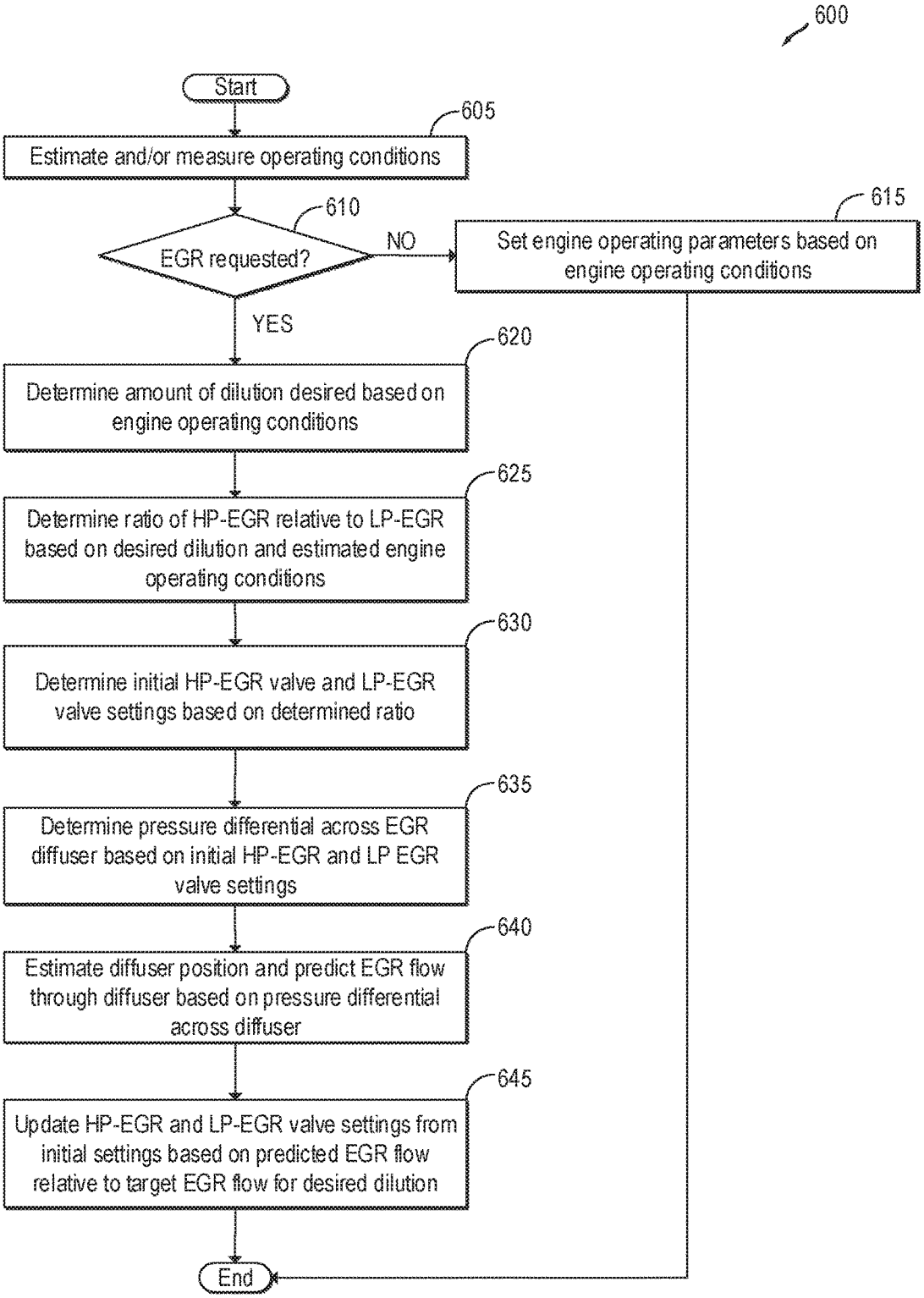
FIG. 6 shows a high level flow chart illustrating an example routine that may be implemented for adjusting the position of an EGR diffuser in response to a request for EGR in an engine intake system.

FIG. 6 shows a high level flow chart illustrating a routine that may be implemented for adjusting the position of an EGR diffuser in response to a request for EGR in an engine intake system. Example routine 600 enables coordination of adjustments to a position of an EGR diffuser (such as EGR diffuser 50*a* or 50*b* of FIG. 1) with an EGR valve (such as LP-EGR valve 24 or HP-EGR valve 34 of FIG. 1) in response to a request for EGR in an engine intake system. The routine incorporates a diffuser with variable geometry to increase homogenous mixing of EGR gases and inlet air at a specific operating condition.

Beginning at 605, the routine includes estimating and/or measuring engine operating conditions. The conditions estimated may include, for example, engine speed, driver torque demand, engine load, engine temperature, exhaust catalyst temperature, exhaust air-fuel ratio, boost demand, etc.

Routine 600 continues at 610 to determine whether EGR is requested, based on the engine operating parameters at 605. EGR may be requested at low-mid load engine operating conditions to boost fuel economy and reduce NOx emissions. EGR may be disabled at high loads as it may increase combustion instability. If it is determined that EGR is not requested, routine 600 proceeds to 615 to set engine operating parameters based on engine operating conditions.

If EGR is requested, an amount of engine dilution required is determined based on engine operating conditions at 620. The dilution represents the desired total amount of dilution of an intake aircharge with EGR gases introduced from the high pressure and/or low pressure loops. An example map showing changes in dilution based on engine speed and load will be described in more detail with regard to FIG. 7 below.

Routine 600 continues at 625 to determine the ratio of high pressure EGR (HP-EGR) relative to low pressure EGR (LP-EGR) based on the desired dilution and estimated engine operating conditions. In one example, the ratio of HP-EGR to LP-EGR may be based on engine boost pressure, the ratio of HP-EGR increased relative to LP-EGR as the boost pressure increases. As such, if the engine is operating without boost, all the requested engine dilution may be provided as LP-EGR. In one example, the desired ratio may be determined based on the output of a look-up table stored in the engine controller's memory as a function of engine speed and load.

At 630, initial positions and settings may be determined for each of a LP-EGR valve located in an EGR loop leading from downstream of the turbine to an air inlet upstream of the compressor (e.g., first EGR loop 22 of FIG. 1) and a HP-EGR valve located in an EGR loop leading from the engine exhaust to an inlet duct of the engine (e.g., second EGR loop 32 of FIG. 1) based on the determined ratio. For example, the LP-EGR and HP-EGR valve settings are determined based on the portion of gases to be delivered via the high pressure and low pressure loops. Specifically, the position of the valve determines the flow of gases past the valve and through the EGR diffuser. Based on the amount of dilution to be delivered as HP-EGR or LP-EGR, the HP-EGR and LP-EGR valves may be positioned to allow a specific volume of gases to flow through the diffuser to achieve the desired dilution of the engine intake air. As an example, as the ratio of HP-EGR increases, an opening of the HP-EGR valve may be increased (while the opening of the LP-EGR valve is correspondingly decreased). Likewise, as the ratio of LP-EGR increases, an opening of the LP-EGR valve may be increased (while the opening of the HP-EGR valve is correspondingly decreased).

At 635, the pressure differential across the EGR diffuser may be determined based on the initial HP-EGR and LP-EGR valve settings. That is, based on the configuration of the valves, EGR flows through the diffuser at a particular rate, creating a pressure differential between the corresponding EGR duct and air inlet duct. In addition, the pressure differential at the EGR duct and air inlet duct may be further influenced by the manifold air pressure flowing through the engine intake (e.g., MAP), the manifold air controlled by a throttle located upstream of the diffuser, such as throttle 18 or throttle 36 of FIG. 1. By determining the pressure differential created by the initial valve settings, adjustments may be made to obtain desired HP-EGR and LP-EGR levels.

Routine 600 continues at 640 to estimate a diffuser position and predict EGR flow through the diffuser based on the pressure differential across the diffuser. The position of the diffuser may further influence the rate at which the EGR flows into the inlet duct. As an example, as the opening of the HP-EGR valve and the LP-EGR valve is decreased to deliver less EGR, the pressure differential across the diffuser may decrease, causing the sleeve of the diffuser to move relative to the diffuser body such that each of the corresponding openings provided in the sleeve may align with, or substantially overlap, the openings provided in the diffuser body (as shown in FIG. 3*a*). That is, as the pressure differential decreases, the diffuser may be shifted to a more open configuration wherein the size of the outlets of the variable EGR diffuser is larger. In one example, this is a default position of the diffuser. In the open position, the diffuser is able to deliver EGR gases into the airstream without any restriction, allowing for a portion of EGR to be provided easily when the pressure differential is low.

As another example, as the opening of the HP-EGR valve and the LP-EGR valve is increased to deliver more EGR, the pressure differential across the diffuser may increase, causing the sleeve of the diffuser to move relative to the diffuser body such that each of the corresponding openings have a smaller overlap with the openings in the diffuser body (as shown in FIG. 3*b*). That is, as the pressure differential increases, the diffuser may be shifted to a more closed configuration. The restriction of air flow within the inlet air duct may enable the diffuser to jet EGR gases into the air stream with a higher force, increasing the mixing of the EGR with the intake air.

As shown in FIG. 3*a*, the resilient element, or coil spring, is biased to return to a position in which the outlet size is larger, e.g., the diffuser is in a more "open" position. In this way, when the outlet size is larger, intake air from the engine may flow through with least resistance, reducing the pressure differential between the inlet duct and EGR duct. In comparison, when the outlet size is reduced, such as shown in FIG. 3*b*, the coil spring is compressed due to LP-EGR flowing through the diffuser, moving the diffuser to a more "closed" position. This may be useful when a jet stream of EGR is requested for engine operation as it creates a high pressure differential between the inlet duct and EGR duct, allowing EGR to flow more forcefully through the diffuser. Alternatives to a coil spring, such as resilient elements in alternate embodiments (e.g., support legs, diffuser fins), may also act to restrict or encourage EGR gas flow through the diffuser.

At 645, the position of the HP- and LP-EGR valve may be updated from the initial settings based on predicted EGR flow relative to target EGR flow to provide the desired dilution. For example, if the predicted LP-EGR flow, as updated based on the EGR diffuser position, is lower than the desired LP-EGR flow, an opening of the LP-EGR valve may be further increased while the opening of the HP-EGR valve is correspondingly decreased. As another example, if the predicted HP-EGR flow, as updated based on the EGR diffuser position, is lower than the desired HP-EGR flow, an opening of the HP-EGR valve may be further increased while the opening of the LP-EGR valve is correspondingly decreased. In one example, the desired dilution may be determined based on the output of a look-up table stored in the engine controller's memory as a function of engine speed and load.

In this way, the opening of each of a HP-EGR valve and a LP-EGR valve may be adjusted based on the resulting pressure differential at the EGR diffuser (and thereby the resulting opening of the EGR diffuser) so as to provide a target ratio of HP-EGR to LP-EGR. Routine 600 may end.

From this, a controller (such as controller 112 of FIG. 1) with computer readable instructions stored on non-transitory memory, based on a target EGR flow movement, may estimate an initial position for each of the first and second valve based on the target dilution requirement, estimate a pressure differential across the diffuser system based on the initial position of each of the first and second valve, predict an expected EGR flow through the outlet based on the estimated pressure differential, update the initial position for each of the first and second valve based on the expected EGR flow to provide the target dilution requirement, and further estimate the initial position for each of the first and the second valve based on a boost pressure.

Figure 7:
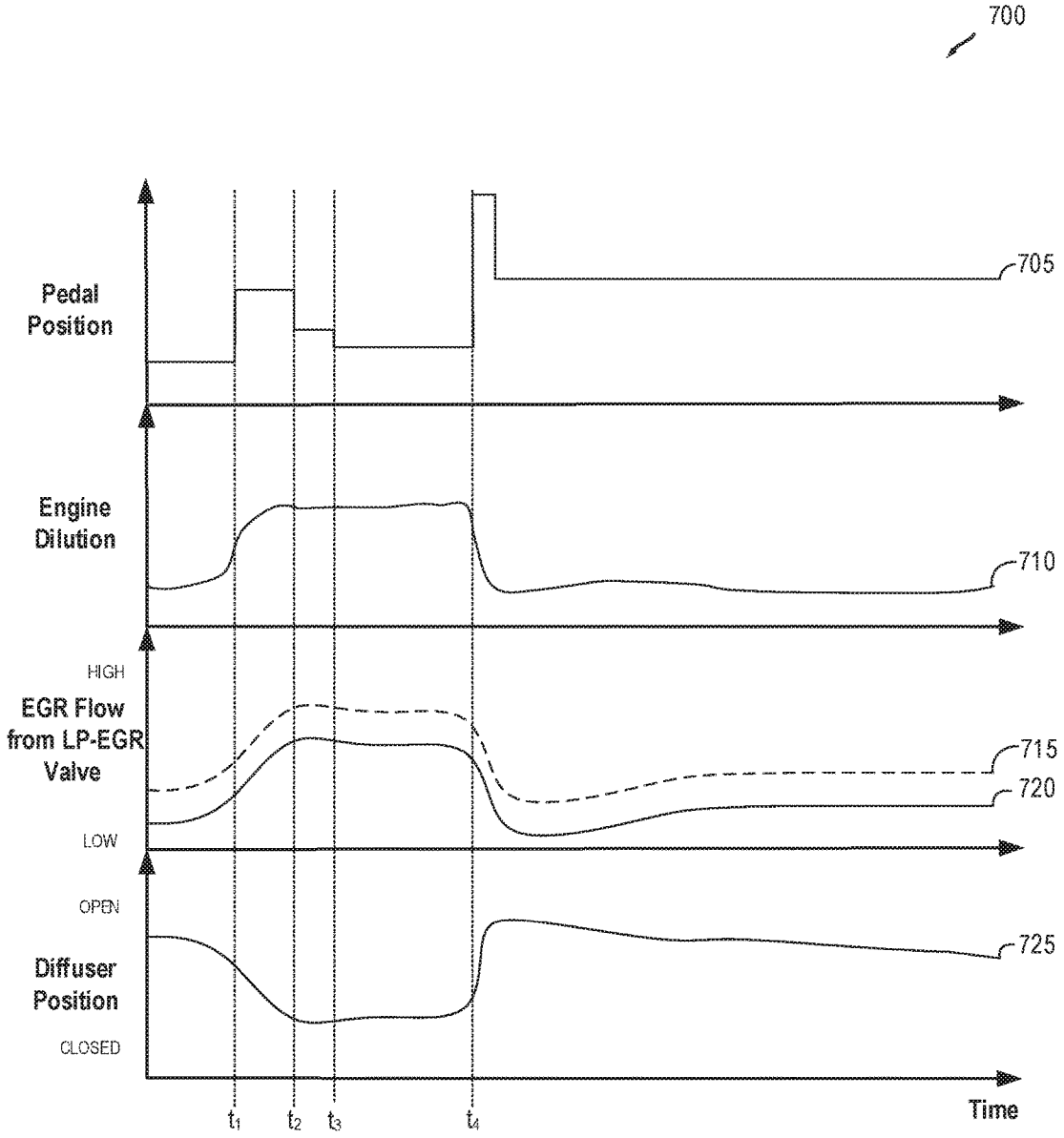
FIG. 7 shows an example map showing changes in the flow of EGR as a speed of a vehicle changes.

An example map showing changes in the flow of EGR based on adjustments to a LP-EGR valve due to changes in engine operating conditions is now elaborated with reference to the example of FIG. 7. Though the example map of FIG. 7 shows adjustments to an LP-EGR valve, it will be appreciated that in alternate examples, similar adjustments may be made to an HP-EGR valve to provide a target engine dilution.

Specifically, map 700 of FIG. 7 depicts changes in operator accelerator pedal position at plot 705, corresponding changes to the dilution of engine intake air at plot 710, LP-EGR flow at plot 715 and 720, and changes in the position of the diffuser at plot 725. The dilution of the engine intake air occurs as fresh airflow from the intake is introduced to EGR gases flowing out the EGR diffuser. The dilution of the engine intake air may change based on engine operating conditions, as explained in further detail below. The LP-EGR valve adjusts the flow rate of LP-EGR mass flowing through the system, diluting the engine intake air. The flow rate of the LP-EGR gases is further influenced by the opening of the EGR diffuser. Adjustments to the flow of EGR based on a position of the EGR diffuser (plot 720) are compared to corresponding adjustments in the absence of an EGR diffuser (plot 715).

Prior to t1, the engine may be operating in a low speed-load region and therefore may be operated with EGR delivered at a lower rate to meet the lower engine dilution demand. In one example, the lower EGR rate may be a fixed rate of EGR relative to air flow, with the pedal position maintained in a constant position (plot 705). The desired engine air dilution (plot 710) may be provided by opening the LP-EGR valve to a smaller degree to adjust flow of EGR through the LP-EGR valve (plot 720) which results in a smaller opening of the diffuser (plot 725).

At t1, responsive to an operator pedal tip-in, there may be a transient shift to a higher engine speed-load condition (e.g., to a mid speed-load range). In response to the light acceleration to the mid speed-load range, the target EGR rate may be increased and correspondingly an opening of the LP-EGR valve may be increased. In particular, the LP-EGR valve opening required to provide the target EGR rate is shown at plot 715 (dashed line). As a result of the increase in LP-EGR valve opening, however, a pressure differential is created across the diffuser. In particular, the pressure from the flow of LP-EGR compresses the coil spring, decreasing the diffuser opening and moving the diffuser to a more closed position (plot 725). As a result of the restriction across the diffuser, EGR is flowed into the inlet duct with a higher force, thereby increasing engine dilution (plot 710). Consequently, by leveraging the jet force generated on the EGR flow via the diffuser, the actual LP-EGR valve setting required to provide the target dilution is set to be lower (plot 720, solid line). As such, if an EGR diffuser were not present, a larger LP-EGR valve opening may have been required to provide the same engine dilution, as indicated at plot 715.

Continuing at t2, responsive to an operator pedal tip-out event, a transition to a lower engine speed-load range may occur. The engine dilution demand may be maintained and correspondingly, the LP-EGR valve settings may also be maintained.

At t3, another tip-out event occurs (plot 705) and dilution continues to be maintained (plot 710) by maintaining the opening of the LP-EGR valve and by maintaining the flow of EGR through the inlet duct.

Between t3 and t4, operation of the vehicle continues under cruise conditions (plot 705). The engine dilution is maintained (plot 710) while flow through the LP-EGR remains steady (plot 720) and the diffuser remains in a less open position to deliver the demanded EGR with higher force (plot 725).

At t4, responsive to a larger tip-in and a vehicle operator high torque demand (plot 705), the engine is transitioned to a high engine speed-load region. At the high torque demand, a higher engine output is desired, requiring more fresh air. Thus, the demand for EGR is reduced. Accordingly, to reduce the engine dilution, the opening of the LP-EGR valve is decreased to reduce the delivered EGR (plot 720). With the drop in EGR flow, the coil spring of the diffuser expands causing the diffuser to shift to a more open position (plot 725). The limited EGR flows into the inlet duct unobstructed and the engine dilution decreases (plot 710).

Following the tip-in at t4, the pedal position remains steady (plot 705). Consequently, the demand for EGR remains the same. As such, flow through the EGR valve levels (plot 720) maintaining the diffuser in an open position (plot 725), thus maintaining a steady dilution as EGR flows into the inlet duct (plot 710). Map 700 may end.

In this way, by using an EGR diffuser to control the flow characteristics of EGR as it enters into an air inlet duct, mixing of EGR with aircharge can be increased. As such, this allows a desired engine dilution to be better provided. By relying on a pressure differential created across the EGR diffuser to move diffuser components relative to one another, a flow restriction provided by openings in the diffuser may be controlled without the need for expensive components. By updating an EGR valve opening based on the pressure differential across the EGR diffuser, and while compensating for the flow characteristics of the EGR through the openings of the diffuser, a target dilution may be provided with increased EGR mixing.

In one embodiment, an Exhaust Gas Recirculation (EGR) system for an internal combustion engine, the EGR system comprises an inlet air duct configured to provide the internal combustion engine with inlet air; an EGR diffuser configured to provide recirculated exhaust gases from the internal combustion engine to the inlet air duct through an outlet, the EGR diffuser comprising: a body portion; and a movable element movable relative to the body portion, the movable element configured to vary the size of the outlet, the movable element comprising a pressure surface arranged such that at least one of inlet air and recirculated exhaust gases act on the pressure surface thereby causing the movable element to move in a first direction and vary the size of the outlet; wherein the movable element is biased to move in a second direction. In a first example of the EGR system for the internal combustion engine, the system further comprises a resilient element configured to resist movement of the movable element. A second example of the EGR system for the internal combustion engine optionally includes the first example and further includes wherein the resilient element is provided between the movable element and the body portion of the EGR diffuser. A third example of the EGR system for the internal combustion engine optionally includes one or more or both of the first and second examples, and further includes wherein the movable element is provided in the inlet air duct and is configured to restrict the flow of air within the inlet air duct; and wherein movement of the movable element varies the restriction of flow of air within the inlet air duct. A fourth example of the EGR system for the internal combustion engine optionally includes one or more or each of the first through third examples, and further includes wherein the movable element is movable between a first position and a second position, a flow area through the outlet being greater in the first position as compared to the second position. A fifth example of the EGR system for the internal combustion engine optionally includes one or more or each of the first through fourth examples, and further includes wherein the movable element is configured to restrict the flow of air within the inlet air duct least when the movable element is in the first position. A sixth example of the EGR system for the internal combustion engine optionally includes one or more or each of the first through fifth examples, and further includes wherein the flow area through the outlet varies non-linearly with the movement of the movable element between the first and second positions. A seventh example of the EGR system for the internal combustion engine optionally includes one or more or each of the first through sixth examples, and further includes wherein a rate of change of the outlet flow area with the movement of the movable element increases as the movable element moves from the first position to the second position. An eighth example of the EGR system for the internal combustion engine optionally includes one or more or each of the first through seventh examples, and further includes wherein the flow area through the outlet varies linearly with the movement of the movable element between the first and second positions. A ninth example of the EGR system for the internal combustion engine optionally includes one or more or each of the first through seventh examples, and further includes wherein the movable element comprises a sleeve arranged co-axially with the body portion of the EGR diffuser, wherein the body portion and the sleeve comprise respective openings; and wherein the outlet is at least partially formed by an overlapping area of the respective openings. A tenth example of the EGR system for the internal combustion engine optionally includes one or more or each of the first through seventh examples, and further includes wherein the sleeve is provided radially outside the body portion. An eleventh example of the EGR system for the internal combustion engine optionally includes one or more or each of the first through seventh examples, and further includes wherein the sleeve is provided radially inside the body portion. A twelfth example of the EGR system for the internal combustion engine optionally includes one or more or each of the first through seventh examples, and further includes wherein the openings each comprise two substantially straight edges, which are parallel to the coincident axes of the body portion and the sleeve. A thirteenth example of the EGR system for the internal combustion engine optionally includes one or more or each of the first through seventh examples, and further includes wherein the openings comprise semi-circular end profiles. A fourteenth example of the EGR system for the internal combustion engine optionally includes one or more or each of the first through seventh examples, and further includes wherein the openings are substantially triangular shaped. A fifteenth example of the EGR system for the internal combustion engine optionally includes one or more or each of the first through seventh examples, and further includes wherein the resilient element comprises a coil spring provided between the body portion and the sleeve. A sixteenth example of the EGR system for the internal combustion engine optionally includes one or more or each of the first through seventh examples, and further includes wherein the movable element comprises a plate configured to cover an opening provided on the body portion, the outlet at least partially formed by a flow area between the plate and the body portion, wherein the resilient element is provided between the plate and the body portion, and wherein the plate is provided within the inlet duct and restricts the flow of inlet air. A seventeenth example of the EGR system for the internal combustion engine optionally includes one or more or each of the first through seventh examples, and further includes wherein the plate further comprises one or more fins, which are acted upon by the flow of inlet air, and wherein the pressure surface comprises a surface of the plate and a surface of the fin.

In a second embodiment, a method comprises an engine including an intake and an exhaust; a turbocharger with an intake compressor driven by an exhaust turbine; an EGR system including a high pressure EGR passage with a first valve for recirculating exhaust gas from the engine exhaust, upstream of the turbine, to the engine intake, downstream of the compressor, and a low pressure EGR passage with a second valve for recirculating exhaust gas from the engine exhaust, downstream of the turbine, to the engine intake, upstream of the compressor, each of the high and lower pressure passage including an EGR diffuser system coupled to the engine exhaust, the EGR diffuser system including a movable element movable relative to a body portion to create an outlet; and a controller with computer readable instructions stored on non-transitory memory for: based on a target EGR flow requirement, estimating an initial position for each of the first and the second valve based on the target dilution requirement; estimating a pressure differential across the diffuser system based on the initial position of each of the first and the second valve; predicting an expected EGR flow through the outlet based on the estimated pressure differential; and updating the initial position for each of the first and the second valve based on the expected EGR flow to provide the target dilution requirement. In a first example of the method, the method further comprises wherein the controller includes further instructions for: further estimating the initial position for each of the first and the second valve based on a boost pressure.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

It will be appreciated by those skilled in the art that although the invention has been described by way of example, with reference to one or more examples, it is not limited the disclosed examples and that other examples may be constructed without departing form the scope of the invention, as defined by the appended claims.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An Exhaust Gas Recirculation (EGR) system for an internal combustion engine, the EGR system comprising:

an inlet air duct in fluidic communication with the internal combustion engine;

an EGR diffuser extending into the inlet air duct to provide recirculated exhaust gases from the internal combustion engine to the inlet air duct through an outlet, the EGR diffuser further comprising:

a diffuser body at least partially positioned within the inlet air duct; and a movable element including a pressure surface coupled and being movably relative to the diffuser body to vary a size of the outlet based on/with respect to a pressure of at least one of inlet air flow and recirculated exhaust gas flow acting on the pressure surface;

wherein the movable element moves in a second direction different from a first direction based on a change of the pressure of the at least one of inlet air flow and recirculated exhaust gas flow exerted on the pressure surface.

2. The EGR system of claim 1, further comprising a spring configured to resist movement of the movable element.

3. The EGR system of claim 2, wherein the spring is provided between the movable element and the diffuser body of the EGR diffuser.

4. The EGR system of claim 2, wherein the spring comprises a coil spring provided between the diffuser body and the sleeve.

5. The EGR system of claim 2, wherein the pressure surface is provided on an end cap of the sleeve;

wherein the movable element comprises a plate configured to cover an opening provided on the diffuser body, the outlet at least partially formed by a flow area between the plate and the diffuser body;

wherein the spring is provided between the plate and the diffuser body; and wherein the plate is provided within the inlet air duct and restricts the inlet air flow.

6. The EGR system of claim 5, wherein the plate further comprises one or more fins, which are acted upon by the inlet air flow; and wherein the pressure surface further comprises a surface of the plate and a surface of the one or more fins.

7. The EGR system of claim 1, wherein the movable element is provided in the inlet air duct and is configured to restrict the inlet air flow within the inlet air duct; and wherein movement of the movable element varies the restriction of the inlet air flow within the inlet air duct; and wherein the movable element is movable between a first position and a second position, a flow area through the outlet being greater in the first position as compared to the second position.

8. The EGR system of claim 7, wherein the movable element restricts the inlet air flow within the inlet air duct least when the movable element is in the first position.

9. The EGR system of claim 7, wherein a rate of change of the flow area of the outlet with the movement of the movable element increases as the movable element moves from the first position to the second position.

10. The EGR system of claim 1, wherein the movable element comprises a sleeve arranged co-axially with the diffuser body of the EGR diffuser;

wherein the diffuser body and the sleeve comprise respective openings; and wherein the outlet is at least partially formed by an overlapping area of the respective openings.

11. The EGR system of claim 10, wherein the sleeve is provided radially outside the diffuser body.

12. The EGR system of claim 11, wherein the openings comprise semi-circular end profiles.

13. The EGR system of claim 10, wherein the sleeve is provided radially inside the diffuser body.

14. The EGR system of claim 11, wherein the openings each comprise two straight edges, which are parallel to coincident axes of the diffuser body and the sleeve.

15. A method for operating an engine including:

an intake and an exhaust;

a turbocharger with an intake compressor driven by an exhaust turbine;

an EGR system;

wherein the EGR system includes:

a high pressure EGR passage with a first valve for recirculating exhaust gas from the engine exhaust, upstream of the exhaust turbine, to the engine intake, downstream of the intake compressor; and a low pressure EGR passage with a second valve for recirculating exhaust gas from the engine exhaust, downstream of the exhaust turbine, to the engine intake, upstream of the intake compressor;

wherein each of the high pressure passage and the low pressure passage includes an EGR diffuser system coupled to the engine exhaust;

wherein the EGR diffuser system includes a movable plate movable relative to a diffuser body to create an outlet; and the method comprising:

during an engine operation, estimating an initial position for each of the first and the second valves based on the target EGR flow requirement via an engine controller;

estimating a pressure differential across the EGR diffuser system based on the initial position of each of the first and the second valves via the engine controller;

predicting an expected EGR flow through the outlet based on the estimated pressure differential via the engine controller;

updating the initial position for each of the first and the second valves based on the expected EGR flow to provide the target EGR flow requirement via the engine controller; and adjusting the first and second valves according to the updated initial position of each of the first and second valves via the engine controller.

16. The method of claim 15, wherein the initial position for said each of the first and the second valves is further based on at least one sensor.

* * * * *